United States Patent [19]

Leroy et al.

[11] 4,045,007

[45] Aug. 30, 1977

[54] BLAST PIPE FOR METALLURGICAL CONVERTERS

[75] Inventors: Pierre Leroy, Saint-Germain-en-Laye; Emile Sprunck, Moyeuvre-Grande, both of France

[73] Assignee: Emile Sprunck, Moyeuvre-Grande, France

[21] Appl. No.: 691,435

[22] Filed: June 1, 1976

[30] Foreign Application Priority Data

June 25, 1975 France ..... 75.19843

[51] Int. Cl.[2] ..... C21C 5/48

[52] U.S. Cl. ..... 266/268; 266/222

[58] Field of Search ..... 75/60; 110/182.5; 122/6.6; 239/423–425; 266/222, 268, 270

[56] References Cited

U.S. PATENT DOCUMENTS

| | | | |
|---|---|---|---|
| 2,613,737 | 10/1952 | Schweitert | 239/425 |
| 2,935,128 | 5/1960 | Ferguson | 239/425 |
| 3,706,520 | 12/1972 | Grimm et al. | 239/423 |

*Primary Examiner*—Gerald A. Dost

[57] ABSTRACT

A blast pipe is formed of a plurality of concentric tubes, the cross-sections of which are designed for the fluid flows required for the refining of a metal bath, which are used initially as a burner. A second tube adjacent an outermost tube, projects beyond the end of the outermost tube, and is provided with a row of orifices in the projecting portion. The end of the second tube is closed by a metal cap soldered to the second tube with a hard solder which melts at a predetermined temperature in relation to the metal of the bath to be refined.

4 Claims, 2 Drawing Figures

BLAST PIPE FOR METALLURGICAL CONVERTERS

BACKGROUND OF THE INVENTION

Figure 1:
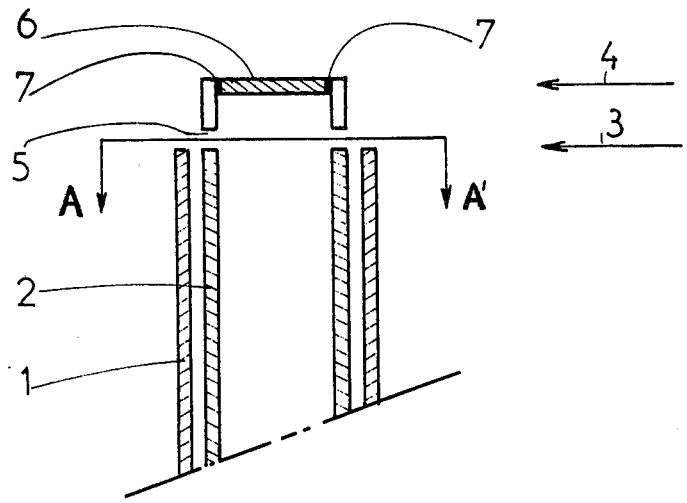

The present invention relates to improvements in blast pipes for use in metallurgical converters.

Quite often metallurgical converters are provided with double or triple blast pipes, that is to say, with two or three concentric tubes, which are protected while in service against wear. The tubes when hot, are acted upon by a liquid or gaseous protective fluid fed to the outer tube. In the majority of cases this protective fluid consists of a hydrocarbon, either as a liquid such as, a fuel-oil or as a gas such, propane, butane, natural gas, etc. These blast pipes are often arranged in the bottom of the converter.

Such a known blast pipe for refinement of the metal bath may also, if the case arises, function as a burner, since it can simultaneously introduce fuel on one hand and a fluid to complete combustion.

However, such a blast pipe is a poor burner because a heavy flow of fluid for completing combustion passes through the central tube and exits at high speed from the nose of the blast pipe, causing a small flow of fuel to pass out the sides of the blast pipe. In other words, mixing of fuel and fluid for completing combustion is very poor and combustion is not satisfactory.

The principal features of the invention relate to a blast pipe for a metallurgical converter comprising a plurality of concentric tubes, the cross-sections of said tubes being adapted to the fluid flows required for the refining of a metal bath. The first outermost tube is fed with a combustible fluid, wherein the second tube, adjacent said first tube, defines on the inside, an annular combustible fluid passage for the passage of gas to complete combustion. The second tube extends beyond said first tube at the end of the blast pipe, and is provided with a row of orifices solely in the projecting portion of the second tube. The end portion of the second tube is closed by a metal cap soldered thereto said end by a hard solder which melts at a predetermined temperature.

The orifices in said second tube preferably all have the same dimensions, are uniformly spaced, have a circular shape or provided with longitudinal slits or the like.

The metal constituting the hard solder of the cap is preferably a metal or alloy, the melting point of which lies between 400° C and 1200° C, depending on the nature of the metal bath to be refined. The metal cap may be of steel (thin sheet) or of a non-ferrous metal.

As will be understood, a blast pipe as above described initially constitutes a burner which can be employed for heating or firing the refractory lining of a metallurgical converter. As soon as the liquid metal is poured into the converter for refining the hard solder fixing the cap so as to close the end of the second tube, melts under the effect of the radiant heat; the refining fluid or fluids then pass into the converter whilst the peripheral fluid protects the blast pipe against wear. In other words, the blast pipe then functions as a blast pipe for refining and no longer as a burner, because the projecting portion of the second tube provided with orifices gets worn away quickly. This transformation from burner to blast pipe for refining is irreversible. But this is not undesirable since it is the lining in the new state which needs to be heated and fired.

SUMMARY OF THE INVENTION

It is another object of the present invention to provide a blast pipe which may function as an efficient burner at the time when it is required to use it as a burner for heating the converter.

Other objects will be more readily understood with respect to the accompanying specification, claims and drawings.

The present invention will be more fully understood from the following description of an embodiment thereof, given by way of example only, with reference to the accompanying drawing.

Figure 2:
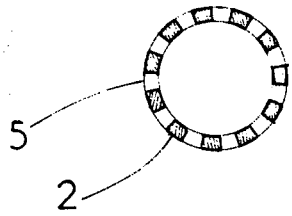

In the drawing:

FIG. 1 is a longitudinal section through the nose or end of a blast pipe in accordance with the invention, and FIG. 2 is a transverse section on the line A–A' in FIG. 1.

PREFERRED EMBODIMENT

As shown in FIGS. 1 and 2, the blast pipe comprises two concentric tubes 1 and 2. The first or outer tube 1 ends at level 3, whilst the second or inner tube 2 projects beyond the end of tube 1 and ends at level 4. The distance between the level 3 and the level 4 may, for example, be 10 millimeters.

The outer tube 1 may, for example, have an internal diameter of 27mm and an external diameter of 32mm, the inner tube 2 having an internal diameter of 20mm and an external diameter of 25mm.

The outer tube 1 is supplied at its other end (not shown) with fuel-oil, whilst the inner tube 2 is supplied with pure oxygen.

Just above the level 3, the inner tube 2 has a crown of circular orifices 5 which are distributed uniformly round the circumference of the tube 2. As shown, there are twelve orifices and each orifice has a diameter of 3mm.

The end of the inner tube 2 at the level 4 is closed by a cap 6 consisting of a thin sheet of steel hard-soldered at 7 to the tube 2 by means of an alloy consisting of a eutectic of 60% copper and 40% zinc which melts at 900° C.

While the invention has been described in terms of a double blast pipe, that is to say, consisting of two concentric tubes, it will be appreciated that the invention is also applicable to triple or multiple blast pipes. In the case of a triple blast pipe it is the intermediate tube (and not the central tube) which projects beyond the end of the outer tube, which is provided with a crown of orifices in its projecting portion, and of which the end is closed by a hard-soldered cap.

There is thus provided a blast pipe which initially constitutes a good burner which can be employed before the first refining operation and which is then transformed without human intervention into a good blast pipe for refining.

Of course one can without departing from the scope of the invention conceive of variants and improvements in detail as well as visualizing the use of equivalent means.

What we claim is:

1. A blast pipe apparatus for a metallurgical converter comprising: a plurality of concentric tubes, including first and second tubes, the cross-sections of said tubes being adapted to fluid flows required for the refining of a metal bath, the first outermost tube of which is to be fed with a combustible fluid; the second tube, adjacent to said first tube, which defines on the inside, an annular combustible fluid passage and which is to be fed with gas to complete the combustion; said second tube extending beyond said first tube at the end of the blast pipe, being provided with a row of orifices arranged in a crown solely in the projecting portion of the said second tube and having its end closed by a metal cap soldered thereto by means of a hard solder which melts at a predetermined temperature.

2. A blast pipe apparatus as claimed in claim 1, wherein: said orifices in the said second tube have the same dimensions and are uniformly spaced around the circumference of said tube.

3. a blast pipe apparatus as claimed in claim 1, wherein: the metal constituting said hard solder of said cap is selected from the group comprising, metals and alloys, the melting points of which lie between 400° C and 1200° C, in dependence on the nature of the metal bath to be refined.

4. A blast pipe apparatus as claimed in claim 1, wherein: said metal cap is made of a material selected from a group comprising steel and non-ferrous metals.

* * * * *